United States Patent [19]

Maloney

[11] 3,973,166

[45] Aug. 3, 1976

[54] DISPLAY PANEL FOR DISPLAYING BARS OF LIGHT

[75] Inventor: Thomas C. Maloney, Bernardsville, N.J.

[73] Assignee: Burroughs Corporation, Detroit, Mich.

[22] Filed: Jan. 17, 1975

[21] Appl. No.: 542,130

Related U.S. Application Data

[63] Continuation of Ser. No. 428,126, Dec. 26, 1973, abandoned.

[52] U.S. Cl. ..... 315/169 TV; 313/217; 313/519; 340/324 R

[51] Int. Cl.[2] ..... H05B 37/00

[58] Field of Search ..... 315/169 R, 169 TV; 340/324 R; 313/513, 514, 518, 519, 188, 217

[56] References Cited

UNITED STATES PATENTS 3,781,600 12/1973 Coleman et al. ..... 315/169 TV 3,806,760 4/1974 Shimada ..... 315/169 TV

*Primary Examiner*—Eugene La Roche

*Attorney, Agent, or Firm*—Paul W. Fish; Robert A. Green; William B. Penn

[57] ABSTRACT

The display panel comprises a gas-filled envelope containing a series of fine, closely-spaced cathode lines connected in groups so that they can be energized sequentially and individually. The panel also includes an anode film supported on the face plate and aligned with and in operative relation with the series of cathode lines. The anode and cathodes are closely spaced and the panel contains an ionizable gas at relatively high pressure.

41 Claims, 3 Drawing Figures

DISPLAY PANEL FOR DISPLAYING BARS OF LIGHT

CROSS-REFERENCE TO RELATED APPLICATIONS

This application is a Continuation of application Ser. No. 428,126, filed Dec. 26, 1973, now abandoned.

BACKGROUND OF THE INVENTION

The principles of the invention are particularly useful for displaying analog signals, and, although devices are known in the prior art for providing a visual display of analog signals, none of these devices is as compact and as simple in construction and operation as the device of the invention.

DESCRIPTION OF THE PREFERRED EMBODIMENTS

A display panel 10 embodying the invention is of generally elongated rectangular shape and includes an insulating base plate 20 of glass, ceramic, or the like, and a face plate 30 of glass or the like and comprising a viewing window for the panel. The base plate and face plate are hermetically sealed together along a predetermined perimeter by means of a glass frit seal (not shown), as is well known in the art.

Figure 1:
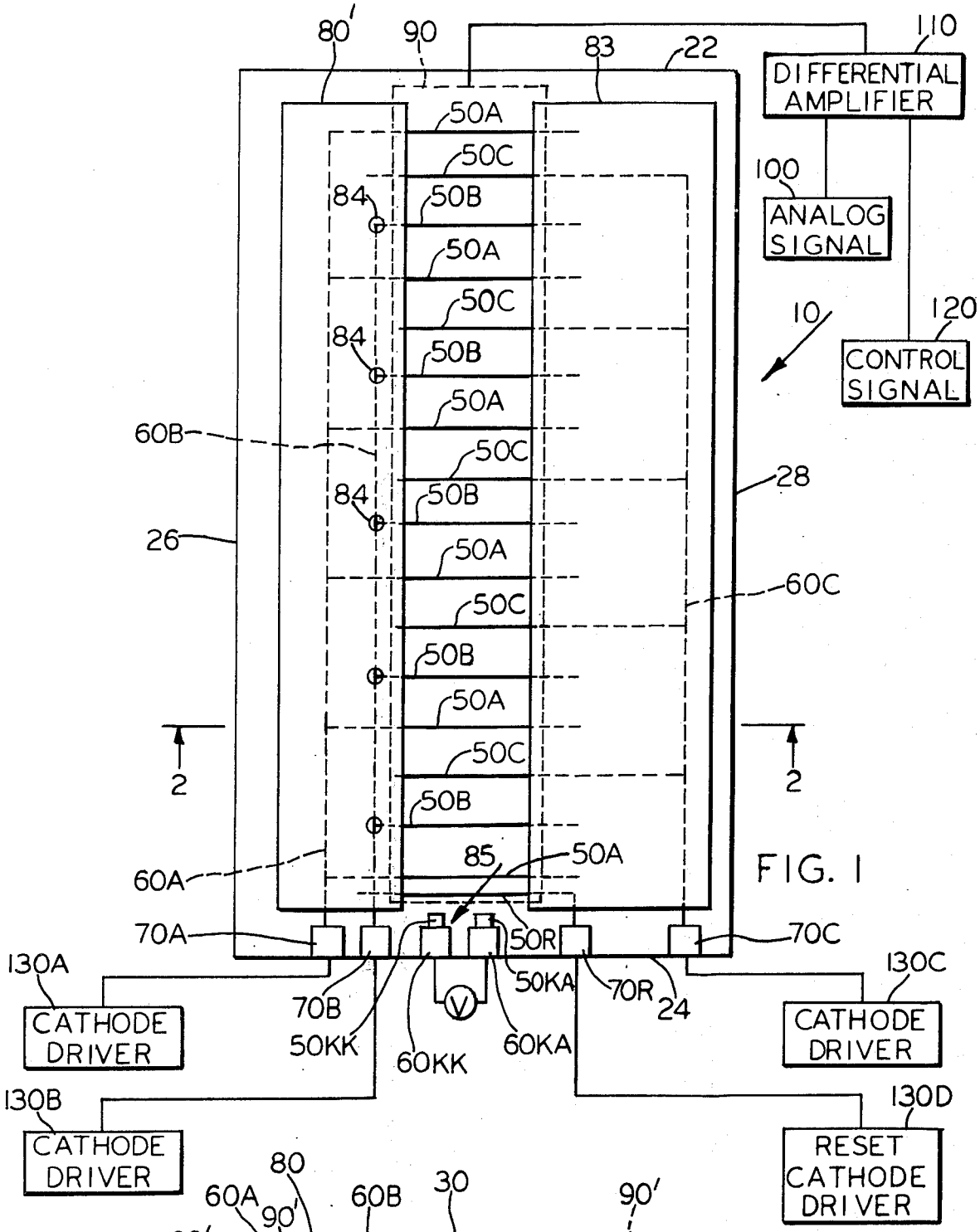
FIG. 1 is a plan view of a display panel embodying the invention.

The base plate 20 includes top and bottom edges 22 and 24, respectively, and left and right side edges 26 and 28, respectively, (FIG. 1). The base plate also includes a top surface, on which is formed a light-absorbing, opaque, preferably black, insulating layer 44 which is provided to optimize the viewing contrast of the panel. A series of short, closely spaced, parallel lines 50A, 50B, 50C of a conductive material are formed on the layer 44, preferably by a silk-screen process. The conductive lines are sufficiently close so that, when the lines are operated as cathodes, the glow of one cathode will appear to merge with the glow of an adjacent cathode. Typically, the cathode lines have a width of about 10 to 12 mils, and they are spaced apart about 5 to 8 mils.

In one arrangement, the conductive lines 50 are oriented perpendicular to the long axis of the base plate, and they are connected in groups, with the lines 50A, 50B, and 50C being in separate groups. Thus, each two A lines are separated by B and C lines, each two B lines are separated by A and C lines, and each two C lines are separated by A and B lines.

Figure 2:
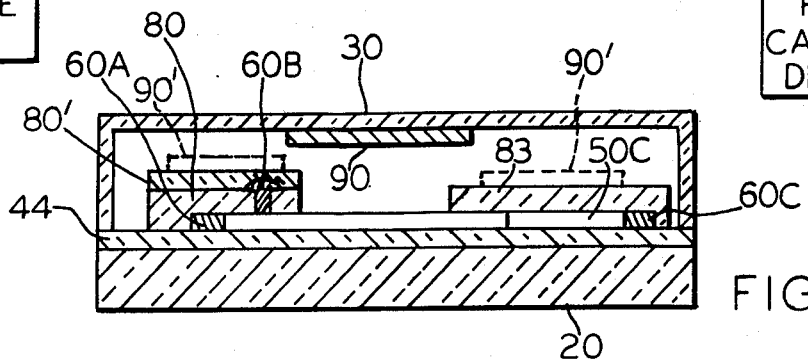
FIG. 2 is a sectional view along the lines 2—2 in FIG. 1.

All of the A lines are connected to a single common conductor 60A which extends parallel to the longitudinal axis of the base plate to the lower edge 24 where it terminates in a contact pad 70A. Similarly, lines 50C are connected to a longitudinal common conductor 60C which terminates in a terminal pad 70C at edge 24 of the base plate. An insulating layer 80 is formed over conductor 60A, with apertures 84 overlaying each of the lines 50B, and a single longitudinal conductor 60B is formed on the insulating layer 80 in contact with each line 50B and terminating in terminal pad 70B. Insulation 80' (FIG. 2) covers line 60B.

A similar insulating layer 83 is formed over the conductor 60C and portions of the conductive lines 50C. In addition, the layers 80 and 83 are spaced apart a suitable distance to provide a desired visible length of each of the conductive lines 50A, B, and C between them. The exposed lengths of these conductive lines, shown as solid black lines in FIG. 1, are the portions which glow in operation of the panel.

The panel includes an auxiliary "reset" cathode line 50R positioned parallel and adjacent to the first line 50A in the series. The conductive line 50R is connected to contact pad 70R, and it is turned on first before the adjacent line 50A in an operating cycle to provide excited particles which insure that the first line 50A itself will turn on when it is electrically energized. In addition, the panel includes a keep-alive cell 85 comprising a small-area anode 50KA and a small-area cathode 50KK disposed adjacent to the lower edge 24 of the base plate and connected to suitable terminal pads 60KK and 60KA. The keep-alive electrodes are positioned in close proximity to reset cathode 50R to provide excited particles therefor. Usually, the keep-alive electrodes are connected to a power source V and are always ON and generating excited particles.

The face plate of the panel includes, on its lower surface, a transparent conductive film anode 90 of tin oxide, gold or the like which comprises a rectangular strip which extends from the upper edge to the lower edge of the panel and overlays the exposed cathode lines 50A, B, and C. The anode is also in operative relation with cathode 50R.

If desired, suitable masks are provided to shield the keep-alive cell 85 and reset cathode 50R from view. Such masks may be opaque films on the face plate, or they may be mechanical shields suitably disposed inside the panel.

In panel 10, the base plate and face plate are spaced apart a distance of the order of 20 to 25 mils, and the gas in the panel is provided at a pressure of the order of 400 Torr. One suitable gas mixture comprises 99.8% neon and 0.2% xenon. Another suitable gas filling is pure neon. With this arrangement of gas pressure and close spacing of base plate and face plate, as each cathode line 50 and the anode 90 are energized, cathode glow can be limited to the close vicinity of a single energized cathode even though the cathodes are connected in groups, and, as glow is transferred from cathode to cathode, no spurious glow develops at undesired locations. This is because the ionized particles, including metastable states, are limited in their ability to diffuse and are neutralized by the closely spaced base plate and face plate.

One suitable circuit for operating panel 10 is shown schematically in FIG. 1 and includes a source 100 of an analog signal, to be displayed, coupled into a differential amplifier 110 along with a ramp or control voltage from source 120. A separate cathode driver 130A, 130B, 130C, is connected to each of the groups of cathode lines 50 by a connection to one of the cathode pads 70 and thus to one of the common connectors. In addition, a reset cathode driver 130R is connected to reset cathode pad 70R, and voltage source V is connected between the electrodes 50KK and 50KA of keep-alive cell 85. In operation of panel 10, as thus connected, the keep-alive cell provides a constant source of excited or ionized particles, and, at the beginning of a scanning cycle, reset cathode driver 130R is operated to apply operating potential to reset cathode 50R to cause it to glow and generate excited particles, and then operating potential is applied by the other cathode drivers 130 sequentially to each of the other cathodes 50 in turn, beginning with cathode 50A adjacent to the reset cathode 50R. Simultaneously, operating potential is applied to the anode 90 from the output of the differential amplifer. As long as there is an output from the differential amplifier, energization of the cathode lines extends from the beginning of the series along the series until the analog signal and the ramp signal are equal. At this time, there is no output from the differential amplifier, and the anode is de-energized; however, the series of cathodes is energized to the end to insure uniform duty cycle each time cathodes are energized. During this time period, the cathodes glow up to a line in the cathode series determined by the magnitude of the analog signal and the length of time during which the anode is energized. Thus, a line of glow is seen extending along a length of the cathode lines representative of the amplitude of the analog signal. This operation is repeated cyclically at such a rate that a stationary but changeable length of light appears to glow in the panel.

Other circuits may also be used to operate the panel 10. For example, a digital clock, controlled by the input analog signal, may be used to sequentially energize the series of cathodes and to simultaneously energize the anode. When the analog signal terminates, the anode is de-energized to cut off cathode glow as described above.

Figure 3:
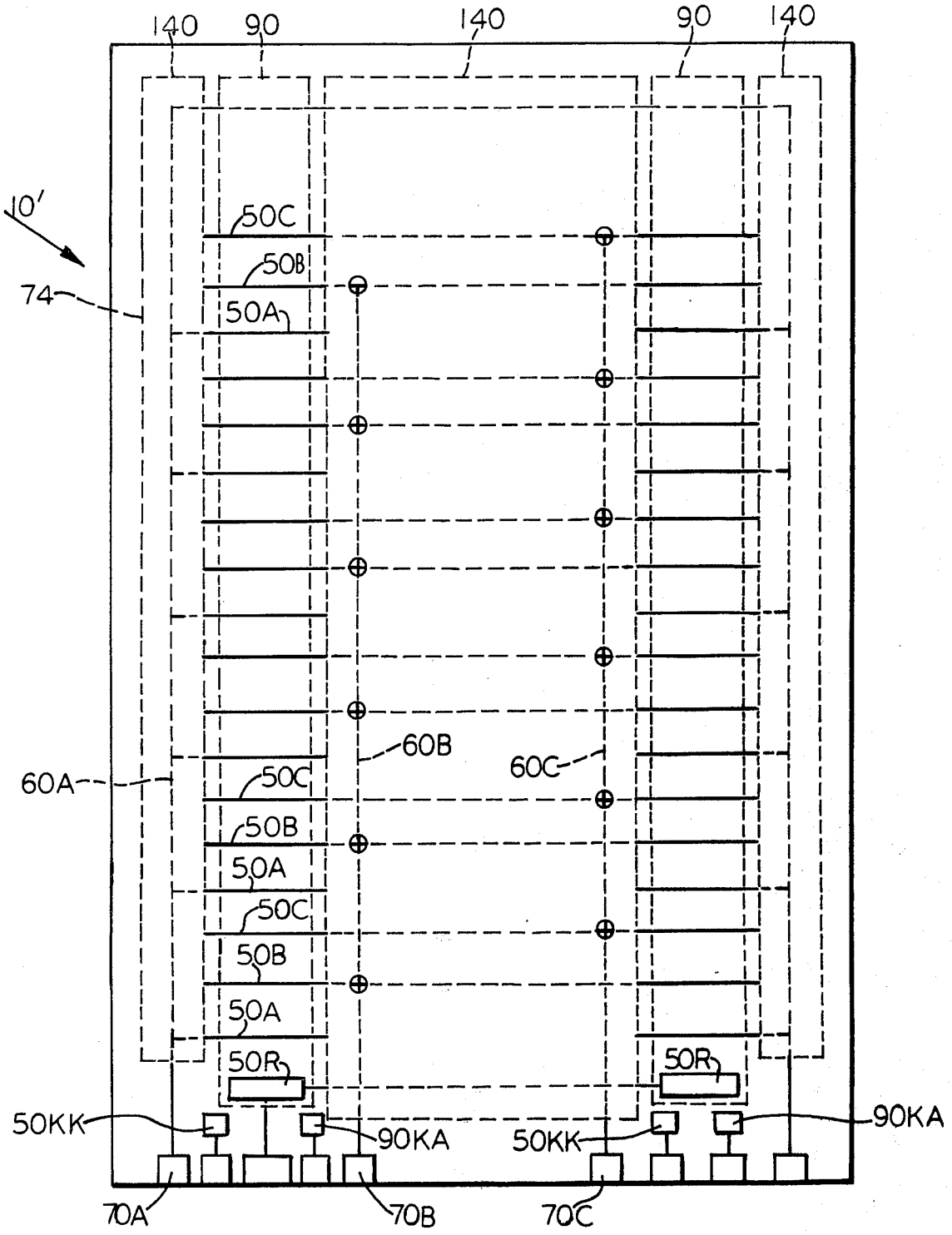
FIG. 3 is a plan view of a modification of the invention.

In a modification of the invention illustrated in FIG. 3, a display panel 10' includes two series of cathode lines, one disposed along each of the opposite long edges of the panel base plate. As in panel 10, the cathodes include cathodes 50A, B, and C, with cathodes 50A interconnected by a common conductor 60A which extends around the perimeter of the base plate and terminates in pads 70A, and with the cathodes 50B connected across the base plate to each other and to a common conductor 60B and to pad 70B, and with the cathodes 50C, connected across the base plate to each other and to a commmon conductor 60C and pad 70C. Using a silkscreen process, the various cathodes and their common conductors can be formed at the same time and of the same material. As described above, suitable insulating layers 140 are provided to insulate cathodes 50B from cathodes 50C and to cover the cathodes to mask them and to provide two series of cathode lines, of suitable length, along each long edge of the base plate. In this case, the face plate has two anode films 90, each overlaying one of the series of cathode lines. In addition, the face plate may be provided with opaque films (not shown) to provide a desired visible pattern for the conductive lines and, for example, to cover auxiliary reset cathode lines 50R positioned adjacent to the first lines 50A and the two keep-alive cells 85 including cathodes 50KK and anodes 90AK and positioned adjacent to both reset cathodes 50R.

The panel 10' is operated in essentially the same way as panel 10 and provides two similar lengths of light representative of an analog input signal.

It is clear that modifications may be made in the specific structural features described above. For example, the anode electrodes may be formed on the face plate, or they may be formed on one of the insulating layers carried by the base plate of the panels described. As an example, anodes 90' are shown in dash lines on layers 80' and 83 in FIG. 2. In addition, a single keep-alive cell could be provided in the panel 10' suitably placed to provide excited particles for both reset electrodes.

What is claimed is:

1. A gas discharge display panel for displaying at least one bar of light of variable length comprising a gas-tight envelope including a viewing window and containing ionizable gas at a pressure capable of sustaining a cathode glow, a substrate of insulating material having one surface facing said viewing window, a succession of cathode electrodes disposed closely adjacent one another in a linear array along said substrate surface, means for establishing an electric field in the region of the first cathode electrode of said array sufficient to initiate a glow discharge along its entire surface, means for establishing electric fields and causing cathode glow, successively, adjacent successive ones of said cathode electrodes in sequence, following said first cathode electrode, each such cathode electrode turning on and exhibiting cathode glow, as said electric field is established adjacent to it, only when it is adjacent a cathode electrode which is glowing, and the glow of each such cathode electrode combining with the glow of the preceding adjacent cathode electrode to form an apparently continuous bar of glow visible through said viewing window, and means including a single anode electrode extending along said entire succession of cathode electrodes, and responsive to an electrical signal applied between said anode and different groups of said cathodes for controlling the number of such cathode electrodes in such groups adjacent which a glow discharge is produced, in accordance with the period of time the electric signal is applied, so that the length of the bar of glow produced by such groups of cathodes represents a characteristic of such applied signal.

2. A display panel as in claim 1 wherein said cathode electrodes are thin parallel linear conductive elements closely spaced side by side along said array, and said anode electrode is transparent conductive material applied to the interior of the viewing window along the length of the cathode electrode array.

3. A display panel as in claim 1 further including means for repetitively scanning said cathode electrodes at a rate above the visually detectable flicker rate, wherein said controlling means selects the same cathode electrodes during a succession of said repetitive scans to present a stationary but changeable bar of glow adjacent said selected cathode electrodes.

4. A display panel as in claim 3 wherein periodic ones of the cathode electrodes are interconnected electrically to form two or more circuits, each of which connects electrically in common a different group of said cathode electrodes, and wherein said means for repetitively scanning said cathode electrodes includes means for applying an electrical signal to said two or more circuits sequentially.

5. A display panel as in claim 4 wherein each said circuit is connected to every third cathode electrode.

6. A gas discharge display panel for displaying at least one bar of light of variable length comprising a gas-tight envelope including a viewing window and containing ionizable gas at a pressure capable of sustaining a cathode glow, a base plate of insulating material having a surface facing said viewing window, a succession of cathode electrodes disposed closely adjacent one another in a linear array along said base plate, each of said cathode electrodes, when energized to a glow discharge condition, exhibiting a glow discharge adjacent its surface which combines with the glow of the preceding cathode electrodes in the succession to form a continuous bar of glow visible through said viewing window, an anode electrode in gas discharge relationship with each of said cathode electrodes, means for scanning each of said cathode electrodes in sequence, from the first to the last such electrode, and means responsive to an applied electrical signal for controlling the number of such cathode electrodes that are energized to a glow discharge condition, so that the length of the bar of glow represents a characteristic of such applied signal, said means including a conductor connected to the anode electrode for applying an electrical signal to the anode, beginning at the time the first cathode electrode is scanned and continuing for a length of time determined by the characteristic of the applied signal that is to be represented by the bar of glow.

7. A display panel as in claim 6 further including scanning means for applying said electrical signal to each cathode electrode in succession in a repetitive scan, and means for synchronizing the application of the electrical signal to the anode with each of said repetitive scans.

8. A gas discharge display panel for displaying at least one bar of light of variable length comprising a gas-tight envelope with a viewing window containing ionizable gas at a pressure capable of sustaining a glow discharge, a succession of first electrodes disposed closely adjacent one another in a linear array along a surface of insulating material located within said envelope, a second electrode in glow discharge relationship with each of said first electrodes, means for applying an electrical signal to said first electrodes successively in repetitive scans, each such first electrodes producing a glow discharge as an electrical signal is applied to it, only when it is adjacent a first electrode which is producing a glow discharge and only when an electrical signal is also being applied to said second electrode, and conductive means connected to said second electrode for applying an electrical signal to said second electrode, during each of said scans, while a selected series of successive first electrodes is being scanned, to produce a glow discharge adjacent said selected first electrodes, the glow of said selected first electrodes combining to form a continuous bar of glow visible through said viewing window.

9. A display panel as in claim 8 wherein the second electrode is an elongated conductive element which extends along the length of the first electrode array.

10. A gas discharge display panel for displaying at least one bar of light of variable length comprising a gas-tight envelope including a viewing window and containing ionizable gas at a pressure capable of sustaining a cathode glow, a succession of cathode electrodes disposed closely adjacent one another in a linear array along a surface of insulating material within said envelope, anode electrode means in gas discharge relationship with said cathode electrodes, means for repetitively scanning all of said cathode electrodes in sequence, and a conductor connected to said anode electrode means for applying an electrical signal to said anode electrode means for a predetermined time during each scan of said cathode electrodes, to initiate a glow discharge adjacent a predetermined series of successive cathode electrodes of the array, the glow of each cathode electrode of said series combining with the glow of the adjacent cathode electrode to form a continuous bar of glow visible through said viewing window, the length of said bar of glow being representative of the time said electrical signal is applied.

11. A display panel as in claim 10 wherein at least each cathode electrode after the first turns on and exhibits a glow only when it is adjacent a cathode electrode which is glowing.

12. A display panel as in claim 11 wherein periodic ones of the cathode electrodes are interconnected electrically to form two or more circuits, each of which connects electrically in common a different group of said cathode electrodes, and wherein said scanning means includes means for applying an electrical signal to said two or more circuits sequentially.

13. A gas discharge display panel for displaying at least one bar of light of variable length comprising a gas-tight envelope including a viewing window and containing ionizable gas at a pressure capable of sustaining a cathode glow, a succession of cathode electrodes disposed clearly adjacent one another in a linear array along a surface of insulating material within said envelope, periodic ones of said cathode electrodes being interconnected electrically to form two or more circuits, each such circuit connecting electrically in common a different group of said cathode electrodes, anode electrode means in gas discharge relationship with said cathode electrodes, means for repetitively scanning at least selected ones of said cathode electrodes by applying an electrical signal, during each scan, between said anode electrode means and said selected ones of said cathode electrodes, one such cathode electrode after another, each cathode electrode, when energized, exhibiting a cathode glow only when it is adjacent a cathode electrode which is glowing, such cathode glow combining with the glow of the adjacent cathode electrode to form a continuous bar of glow visible through said viewing window, and means for applying between said anode and said cathodes an electrical signal for a predetermined time for controlling the number of the cathode electrodes that are energized to a glow discharge condition during each such scan, so that the length of the bar of glow represents a characteristic of such applied signal.

14. A display panel as in claim 13 wherein said scanning means scans all of said cathode electrodes during each scan.

15. A display panel for displaying at least one bar of light of variable length comprising an envelope including a viewing window, a succession of first electrodes disposed closely adjacent one another in a linear array along a surface within said envelope, a second electrode extending along the length of said first electrodes, means for repetitively scanning all of said first electrodes in sequence, and a conductor connected to said second electrode means for applying an electrical signal continuously to said second electrode for a predetermined time during each scan of said first electrodes, to initiate a luminous discharge between a predetermined series of successive first electrodes of the array and said second electrode, the light adjacent each of the first electrodes of said series combining to form a continuous bar of glow visible through said viewing window, representing the length of time said electrical signal is applied to said second electrode.

16. A display panel for displaying at least one bar of light comprising an envelope including a viewing window and containing a luminous discharge medium, a succession of first electrodes disposed closely adjacent one another in a linear array in coupling relationship with said luminous discharge medium, periodic ones of said first electrodes being interconnected electrically to form two or more circuits, each such circuit connecting electrically in common a different group of said first electrodes, second electrode means in operative relationship with and spaced from each of said first electrodes, means for repetitively scanning all of said first electrodes in sequence, and a conductor connected to said second electrode means for applying an electrical signal continuously thereto for a predetermined time during each scan of said first electrodes, beginning at the start of each such scan, to initiate a luminous discharge between a predetermined series of successive first electrodes of the array and said second electrode means, the light produced by each of the second electrodes of said series combining to form a continuous bar of glow visible through said viewing window, representing the length of time said electrical signal is applied to said second electrode.

17. A flat panel for displaying bars of light comprising a gas-filled envelope including a base plate and a viewing face plate hermetically sealed together, a plurality of thin, parallel, linear cathodes disposed in a series along the surface of said base plate and including means whereby each cathode can be separately caused to exhibit cathode glow in turn along said series, an anode electrode overlaying and in operative relation with said series of linear cathodes, the space along said envelope between said anode and said series of cathodes, and along said series of cathodes, being open and unobstructed, and means for electrically energizing each cathode of said series of cathodes in sequence and for electrically energizing said anode while a selected number of said cathodes are being energized, to cause each cathode of said selected number, in turn, to exhibit cathode glow, each cathode turning on and exhibiting cathode glow as it is electrically energized only when said anode is being energized and the cathode is adjacent to a cathode which is already exhibiting cathode glow, the glow of one cathode seeming to blend with the glow of the next cathode in the series, the width of said linear cathodes, the closeness of adjacent cathodes to each other, the spacing of said face plate from said base plate, and the pressure of the gas in said envelope being such that the glow of each cathode, as it is energized, seems to blend with the glow of the adjacent cathode, and all of the cathodes which are energized appear to glow as a continuous bar of light.

18. The panel defined in claim 17 wherein said cathodes are connected in groups with a single common conductor connected to each such group.

19. The panel defined in claim 17 and including a linear reset cathode positioned adjacent to and ahead of the first cathode in said series for use in starting a scanning cycle for said series of cathodes.

20. The panel defined in claim 17 wherein said linear cathodes have a width of about 10 to 12 mils and they are spaced apart about 5 to 8 mils.

21. The panel defined in claim 17 wherein the spacing between the anode and the series of cathodes is about 10 to 25 mils and the gas in the panel is at a pressure of about 400 Torr.

22. A flat panel for displaying bars of light of different lengths comprising a gas-filled envelope including a base plate and a viewing face plate hermetically sealed together, said base plate having first and second opposite edges, a plurality of thin, parallel, linear cathodes disposed in a series along the surface of said base plate, a first common conductor electrically connected to selected ones of said cathodes and disposed adjacent to said first edge of said base plate, a second common conductor secured to others of said cathodes and disposed adjacent to said second edge of said base plate, and an anode electrode overlaying and in operative relation with said series of linear cathodes, the interior of said envelope between said anode and said series of cathodes, and along said series of cathodes, being open and free of any obstructions to the flow of excited particles generated in the gas filling therein.

23. A flat panel for displaying bars of light of different lengths comprising a gas-filled envelope including a base plate and a viewing face plate hermetically sealed together, said base plate having first and second opposite edges, a plurality of thin, parallel, linear cathodes disposed in a series along the surface of said base plate, a first common conductor electrically connected to selected ones of said cathodes and disposed adjacent to said first edge of said base plate, a second common conductor secured to others of said cathodes and disposed adjacent to said second edge of said base plate, an insulating layer over said second common conductor having apertures exposing a portion of each of the remainder of said cathodes, a third common conductor on said insulating layer and making contact through said apertures with said remainder of said cathodes, and an anode electrode overlaying and in operative relation with said series of linear cathodes.

24. A flat panel for displaying bars of light of different lengths comprising a gas-filled envelope including a base plate and a viewing face plate hermetically sealed together, said base plate having first and second opposite edges and first and second opposite ends, a plurality of contact pads disposed along said first end of base plate, a plurality of first thin, parallel, linear cathodes disposed in a series along the surface of said base plate adjacent to said first edge of said base plate, a plurality of second thin, parallel, linear cathodes disposed in a series along the surface of said base plate adjacent to said second edge of said base plate, a first common conductor electrically connected to selected ones of said first cathodes and said second cathodes and extending from one of said contact pads at said first end of said base plate, along said first edge, along the opposite end, and along said second edge to said first end of said base plate, a second common conductor electrically connected to others of said first and second cathodes and extending from a second of said contact pads along said base plate to said second end thereof, a third common conductor electrically connected to the remainder of said first and second cathodes and extending from a third of said contact pads along said base plate to said second end thereof, said second and third common conductors being insulated from each other, and a separate anode electrode overlaying and in operative relation with each of said series of linear cathodes.

25. A flat panel for displaying bars of light of different lengths comprising a gas-filled envelope including a base plate and a viewing face plate hermetically sealed together, said base plate having first and second opposite edges and first and second opposite ends, a plurality of thin, parallel, linear cathodes disposed in a series along the surface of said base plate adjacent to said first edge of said base plate and extending between said first and second ends, a plurality of contact pads disposed along said first end of said base plate, a first common conductor electrically connected to selected ones of said cathodes and extending from one of said contact pads at said first end of said base plate, a second common conductor electrically connected to others of said cathodes and extending from another of said contact pads along said base plate to near said second end thereof, a third common conductor electrically connected to the remainder of said cathodes and extending from another of said contact pads along said base plate to near said second end thereof, said second and third common conductors being insulated from each other, and a separate anode electrode overlaying and in operative relation with said series of linear cathodes.

26. A gas discharge display panel for displaying a bar of light of variable length comprising a gas-tight envelope including a viewing window and containing ionizable gas at a pressure capable of sustaining a cathode glow, a succession of closely spaced cathode glow display electrodes disposed one after another in an array viewable through said viewing window, an anode electrode extending along said array in gas discharge relation with each of said display electrodes, first conductive means connected to said display electrodes for repeatedly scanning said display electrodes, in a succession of scans, during each of which a voltage is applied to each of said display electrodes sequentially, from the first to the last, and second conductive means connected to said anode electrode for applying a voltage signal to said anode electrode during a plurality of consecutive scans, beginning at approximately the start of each such scan and continuing for a predetermined period during the scan while a selected number of consecutive display electrodes are scanned, to establish a glow discharge adjacent said consecutive display electrodes and thus form a bar of glow visible through said viewing window, said second conductive means being responsive to an applied electrical signal for controlling the number of consecutive display electrodes that glow, to control the length of said bar of glow, in response to a characteristic of said applied signal.

27. A display panel as in claim 26 wherein said anode electrode is transparent and is located between the display electrodes and the viewing window.

28. A display panel as in claim 26 wherein the active gaseous particles within the glow discharge adjacent each of said display electrodes migrate to the region of next succeeding display electrode and condition that electrode toward a glow discharge state.

29. A display panel as in claim 28 wherein said first conductive means includes a plurality of conductors each electrically connected to a different group of said display electrodes.

30. A display panel as in claim 28 wherein said first conductive means includes *n* conductors each electrically connected to every nth display electrode.

31. A display panel as in claim 28 further including a starting gas discharge cell adjacent said first display electrode, and means for activating said starting cell just prior to each activation of said first display electrode, to condition said first display electrode toward a glow discharge state.

32. A gas discharge display panel for displaying a bar of light of variable length comprising a gas-tight envelope including a viewing window and containing ionizable gas at a pressure capable of sustaining a cathode glow, a succession of closely spaced cathode glow display electrodes disposed one after another in an array facing said viewing window, anode electrode means in gas discharge relation with each of said display electrodes, and circuit means for establishing a glow discharge viewable through said viewing window adjacent a selectable number of consecutive display electrodes, beginning with the first, to form a bar of glow of selectable length, said circuit means including first conductive means connected to said display electrodes for scanning said display electrodes in repeated scans, during each of which a voltage is applied to each of said display electrodes sequentially, from the first to the last, and second conductive means, responsive to an applied electrical signal, for applying a voltage signal to said anode electrode means during a plurality of consecutive scans, beginning at approximately the start of each such scan and continuing while a predetermined number of successive display electrodes are thereafter scanned, to control the length of said bar of glow in response to a characteristic of said applied signal.

33. A display panel as in claim 32 wherein the active gaseous particles within the glow discharge adjacent each of said display electrodes migrate to the region of next succeeding display electrode and condition that electrode toward a glow discharge state, and wherein said first conductive means includes *n* conductors each electrically connected to every nth display electrode.

34. A gas discharge display panel for displaying a bar of light of variable length comprising a gas-tight envelope including a viewing window and containing ionizable gas at a pressure capable of sustaining a cathode glow, a succession of display electrodes disposed one after another in an array, each capable of exhibiting a cathode glow discharge viewable through said viewing window, said display electrodes being closely spaced and the active gaseous particles within the glow discharge adjacent each migrating to the region of next succeeding display electrode to condition that electrode toward a glow discharge state, anode electrode means extending along said array in gas discharge relation with each of said display electrodes, first conductive means including *n* conductors, each electrically connected to every nth display electrode for repeatedly scanning said display electrodes, in a succession of scans, during each of which a voltage is applied to at least selected ones of said display electrodes sequentially beginning with the first display electrode in the array, and second conductive means connected to said anode electrode means for applying a voltage signal to said anode electrode means during a plurality of consecutive scans, beginning at approximately the start of each such scan and continuing while said selected display electrodes are thereafter successively scanned, to establish a glow discharge adjacent said selected display electrodes and thus form a bar of glow visible through said viewing window, said second conductive means being responsive to an applied electrical signal for selecting the number of display electrodes that glow, to control the length of said bar of glow, in response to a characteristic of said applied signal.

35. A gas discharge display panel comprising a gas-tight envelope including a viewing window and containing ionizable gas at a pressure capable of sustaining a cathode glow, a succession of closely spaced cathode glow display electrodes disposed one after another in an array facing said viewing window, each of said display electrodes, when activated to glow, producing a glow discharge which primes the next succeeding display electrode toward a glow discharge condition, anode electrode means in glow discharge relationship with all of said display electrodes, means for repetitively scanning said display electrodes sequentially from the first to the last, and circuit means for applying a voltage signal to said anode electrode means during a predetermined portion of each of a plurality of consecutive scans and for varying said portion in response to variations in a characteristic of an electrical applied signal, said circuit means including conductive means connected to said anode electrode means, responsive to an applied electrical signal, for applying said voltage signal to said anode electrode means beginning at approximately the start of each such scan and continuing while a selected number of successive display electrodes are thereafter scanned, to cause each of said selected display electrodes to glow, one after another, to control the length of said bar of glow in response to a characteristic of said applied signal.

36. A display panel for displaying a plurality of side-by-side bars of light of variable length, including a plurality of side-by-side display units, each of which comprises a succession of cathode electrodes disposed closely adjacent to one another in a linear array, there being first, second .... $n^{th}$ cathodes in each display unit, circuit means for connecting electrically in common the correspondingly numbered display electrodes of each of said units, each of said cathode electrodes, when energized to a glow discharge condition, exhibiting a glow discharge adjacent its surface which combines with the glow of the adjacent cathode electrodes of the same display unit to form a substantially continuous bar of glow visible through said viewing window, anode electrode means in each such display unit in gas discharge relationship with each of said electrodes of the same unit, means for applying an electrical signal to each of said cathode electrodes in succession, from the first to the last such electrode in each group, and means responsive to applied electrical signals for controlling the number of such cathode electrodes that are energized to glow discharge condition in each such display unit, so that the length of the bar of glow in each such unit represents a characteristic of the applied signals, said means including a conductor connected to the anode electrode means of each such display unit for applying an electrical signal to said anode electrode means, beginning at the time an electrical signal is applied to the first cathode electrode of each display unit and continuing for a length of time determined by the characteristic of each applied signal that is to be represented by the bar of glow.

37. A bar graph display panel comprising a gas-filled envelope made up of an insulating base plate and a face plate having a viewing window, said base plate and face plate being hermetically sealed together, a series of generally linear cathode elements supported on said base plate closely adjacent one another whereby when a group of such cathodes exhibits cathode glow, the glow of one cathode appears to blend with the glow of an adjacent cathode and the total number of cathodes which glow appears to form a bar of light, a plurality of conductors on said base plate extending along said base plate adjacent to said series of cathodes, each conductor being connected to different ones of said cathodes, an insulating layer insulating said conductors from each other and covering said conductors so that they are not visible through said viewing window, and a single anode electrode on the inner surface of said face plate and overlying said series of cathodes.

38. The panel defined in claim 37 wherein said insulating layer covers the edges of said cathodes to provide a series of cathodes which are all of the same uniform length.

39. A bar graph display panel comprising a gas-filled envelope including a base plate and a face plate having a viewing window, said base plate and face plate being hermetically sealed together, a first series of parallel line-like cathode electrodes disposed along a linear path on the surface of said base plate, a first transparent conductive anode electrode on the inner surface of said face plate overlying all of the cathodes in said first series, a second series of parallel line-like cathode electrodes disposed along a linear path on the surface of said base plate, said second series of cathodes being disposed adjacent to and generally parallel to said first series of cathodes, a second transparent conductive anode electrode on the inner surface of said face plate overlying all of the cathodes in said second series, a plurality of conductors on said base plate extending along said base plate adjacent to said first and second series of cathodes, each conductor being connected to a different group of said cathodes in said first series and to corresponding cathodes of said second series, and an insulating layer insulating said conductors from each other and covering said conductors so that they are not visible through said viewing window, and covering the ends of said cathodes so that all of said cathodes have substantially the same well-defined length.

40. A display panel comprising a gas-filled envelope including a base plate and a face plate having a viewing window, a series of cathode electrodes arrayed close to each other in a series along said base plate and including a first cathode, a last cathode, and intermediate cathodes, anode electrode means in operative relation with said series of cathodes, and means for electrically connecting said anode electrode means and said series of cathode electrodes in a circuit and for energizing a group of said cathodes and causing said group of said cathodes to exhibit cathode glow one at a time and sequentially, beginning with the first cathode in the series and proceeding through said series and terminating cathode glow at another cathode in said series, said means also repetitively energizing said group of cathodes to form an apparently stationary bar of light, the number of cathodes in said series which are energized and exhibit cathode glow in said group being related to the amplitude of an input signal applied to said anode electrode means.

41. A gas discharge display panel for displaying at least one bar of light of variable length comprising a gas-tight envelope with a viewing window containing ionizable gas at a pressure capable of sustaining a glow discharge, a succession of coplanar gas discharge cells disposed closely adjacent one another in an array along a surface of insulating material located within said envelope, said succession of cells including a first cell, a last cell and intermediate cells, each said cell being operable as a display cell and as a particle-supply cell for an adjacent cell in the succession, first electrodes and second electrode means coupled to said cells for applying electrical signals thereto and producing glow discharge in a selected series of said cells, said selected series permissibly including less than all of said cells, glow discharge in a cell being produced only when it is adjacent a cell which is producing glow discharge and only when an electrical signal is also being applied to said first and second electrodes, means for applying an electrical signal to each of said first electrodes, and thus to each of said cells, in succession, from the first to the last, and means responsive to an applied electrical signal for controlling the number of such cells that are energized in a series, so that the length of the bar of glow produced by the series represents a characteristic of such applied signal, said means including a conductor connected to said second electrode means for applying an electrical signal thereto beginning at the time an electrical signal is applied to the first cell and continuing for a length of time determined by the characteristic of the applied signal that is to be represented by the bar of glow.

* * * * *